US006742485B2

(12) United States Patent
Lichti

(10) Patent No.: US 6,742,485 B2
(45) Date of Patent: Jun. 1, 2004

(54) CAM PHASER LOCKING PIN ASSEMBLY GUIDE

(75) Inventor: Thomas H. Lichti, Fairport, NY (US)

(73) Assignee: Delphi Technologies, Inc., Troy, MI (US)

( * ) Notice: Subject to any disclaimer, the term of this patent is extended or adjusted under 35 U.S.C. 154(b) by 53 days.

(21) Appl. No.: 10/126,398

(22) Filed: Apr. 19, 2002

(65) Prior Publication Data

US 2003/0196621 A1 Oct. 23, 2003

(51) Int. Cl.[7] ..... F01L 1/34

(52) U.S. Cl. ..... 123/90.17; 123/90.15; 464/2; 464/160; 464/161

(58) Field of Search ..... 123/90.17, 90.15, 123/90.16, 90.18, 90.31; 92/17, 24, 27, 28; 137/385; 70/175; 464/2, 160, 161

(56) References Cited

U.S. PATENT DOCUMENTS 4,483,366 A * 11/1984 Labita ..... 137/385

OTHER PUBLICATIONS

Takenaka, U.S. patent application Publication 2002/0139332, Oct. 3, 2002, Variable Valve Timing Apparatus.*

* cited by examiner

*Primary Examiner*—Thomas Denion
*Assistant Examiner*—Kyle Riddle
(74) *Attorney, Agent, or Firm*—Patrick M. Griffin

(57) ABSTRACT

A vane-type cam phaser wherein a locking pin assembly is disposed between a rotor and a stator of the phaser to selectively couple the rotor and stator together under certain operating conditions, for example, during engine start-up. The central axis of the locking pin assembly is disposed in the rotor parallel to the rotational axis of the phaser. The pin is spring loaded in a default position and is guided through its axial movement by two cylindrical guide surfaces—an inner guide surface and an outer guide surface. The lengths of these guide surfaces are optimized to minimize binding and sluggish operation of the pin caused by lateral forces exerted on the pin by the stator when in operation. The outer guide surface to inner guide surface ratio (L/I) is preferably greater than 2.

5 Claims, 7 Drawing Sheets

CAM PHASER LOCKING PIN ASSEMBLY GUIDE

TECHNICAL FIELD

The present invention relates to cam phasers for altering the phase relationship between valve motion and piston motion in reciprocating internal combustion engines; more particularly, to cam phasers having a vaned rotor rotatably disposed in an internally-lobed stator wherein the rotor and stator can be mechanically locked together by a locking pin; and most particularly where the dimensions of the locking pin and locking pin guide are optimized to prevent binding of the pin in operation.

BACKGROUND OF THE INVENTION

Cam phasers are well known in the automotive art as elements of systems for reducing combustion formation of nitrogen oxides (NOX), reducing emission of unburned hydrocarbons, improving fuel economy, and improving engine torque at various speeds. Typically, a cam phaser employs a first element driven in fixed relationship to the crankshaft and a second element adjacent to the first element and mounted to the end of the camshaft in either the engine head or block. A cam phaser is commonly disposed at the camshaft end opposite the engine flywheel. The first element is typically a cylindrical stator mounted onto a crankshaft-driven gear or pulley, the stator having a plurality of radially-disposed inwardly-extending spaced-apart lobes and an axial bore. The second element is a vaned rotor mounted to the end of the camshaft through the stator axial bore and having vanes disposed between the stator lobes to form actuation chambers therebetween such that limited relative rotational motion is possible between the stator and the rotor. Such a phaser is known in the art as a vane-type cam phaser.

The disposition of the rotor in the stator forms a first, or timing-advancing, array of chambers on first sides of the vanes and a second, or timing-retarding, array of chambers on the opposite sides of the vanes. The apparatus is provided with suitable porting so that hydraulic fluid, for example, engine oil under engine oil pump pressure, can be brought to bear controllably on opposite sides of the vanes in the advancing and retarding chambers. Control circuitry and valving, commonly a multiport spool valve, permit the programmable addition and subtraction of oil to the advance and retard chambers to cause a change in rotational phase between the stator and the rotor, in either the rotationally forward or backwards direction, and hence a change in timing between the pistons and the valves.

Under conditions of low engine oil pump pressure, such as during startup, it is desirable to mechanically lock the rotor and stator together in a default mode to prevent unwanted relative angular movement of the rotor/stator when the pump pressure is not high enough to reliably position the rotor relative to the stator. This is typically accomplished by a hydraulically activated locking pin disposed in the rotor and positioned parallel to the rotational axis of the phaser. In the default position, when the rotor and stator are locked together, a spring biases a cylindrical locking pin outward to engage a pin bore disposed in the stator. When the oil pump pressure reached a pre-determined level, the hydraulic force of the oil causes the locking pin to retract from the pin bore and into the rotor thereby mechanically decoupling the rotor from the stator and permitting cam shaft phasing to occur. When the rotor and stator are locked together in the default mode, the torsional forces applied to the stator by the engine crankshaft are transferred to the rotor/camshaft via lateral loading of the locking pin in the pin bore. This means that, while it is desirable for the pin to be retracted from the coupled mode in a smooth and predictable manner, the additional and irregularly applied frictional bias caused by the lateral loading of the locking pin results in pin retraction and the decoupling event to occur erratically.

What is needed is a means for reducing the frictional bias caused by the lateral loading of the locking pin to permit a more precise control of the oil pump pressure at which the pin is retracted from the pin bore and at which mechanical decoupling of the stator and rotor can occur.

SUMMARY OF THE INVENTION

The present invention is directed to a vane-type camshaft phaser wherein a locking pin assembly is disposed between a rotor and a stator of the phaser to selectively couple the rotor and stator together. The central axis of the locking pin assembly is parallel to the rotational axis of the phaser. The pin is guided through its axial movement by two cylindrical guide surfaces—an inner guide surface and an outer guide surface. The lengths of these guide surfaces are optimized to minimize binding and sluggish operation of the pin caused by lateral forces exerted on the pin when in operation. The outer guide surface to inner guide surface ratio (L/I) is preferably greater than 2.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

Figure 1A:
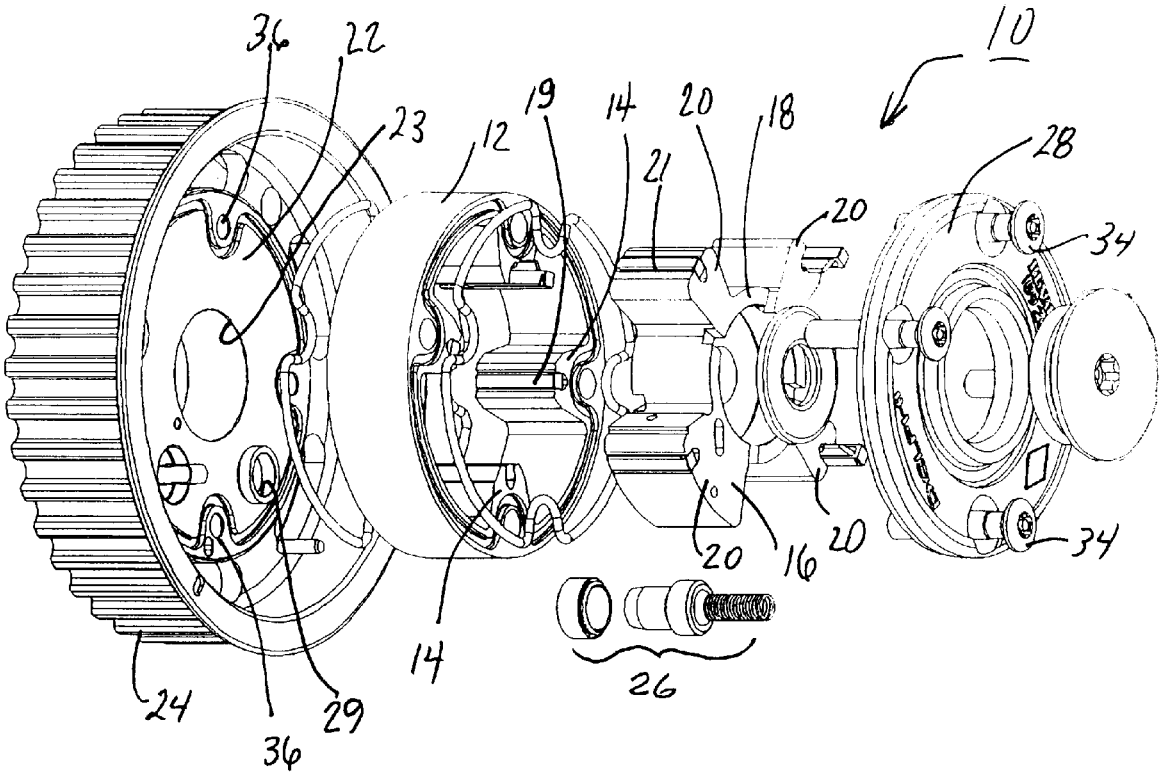
FIG. 1*a* is an exploded isometric view of a vaned cam phaser.
Figure 1B:
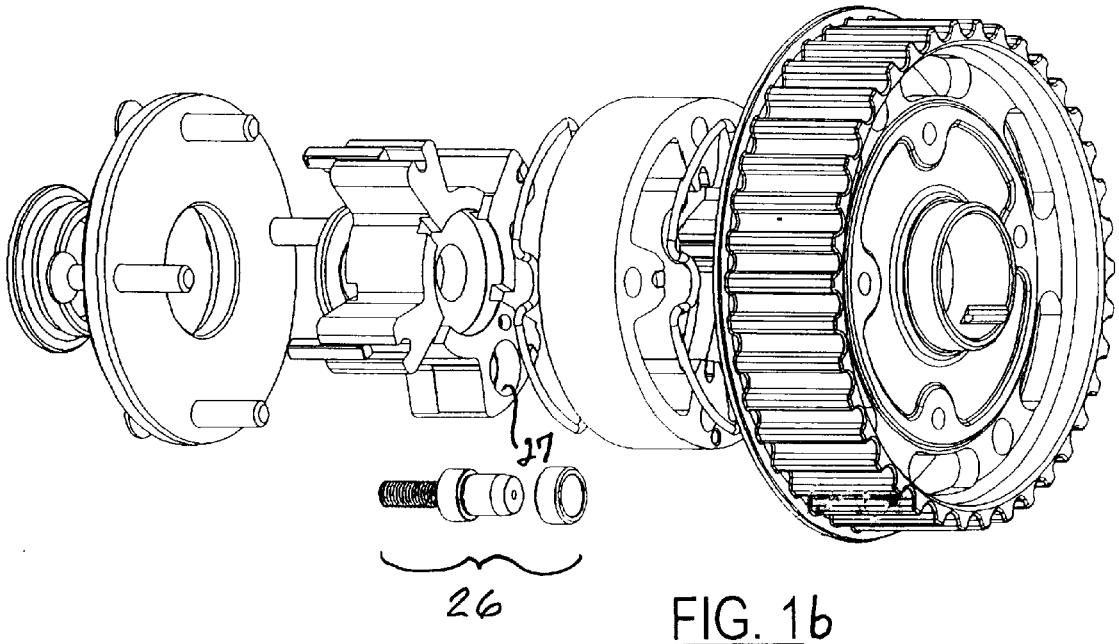
FIG. 1*b* is an exploded isometric view of a the vaned cam phaser of FIG. 1*a*, looking from the bottom.
Figure 2:
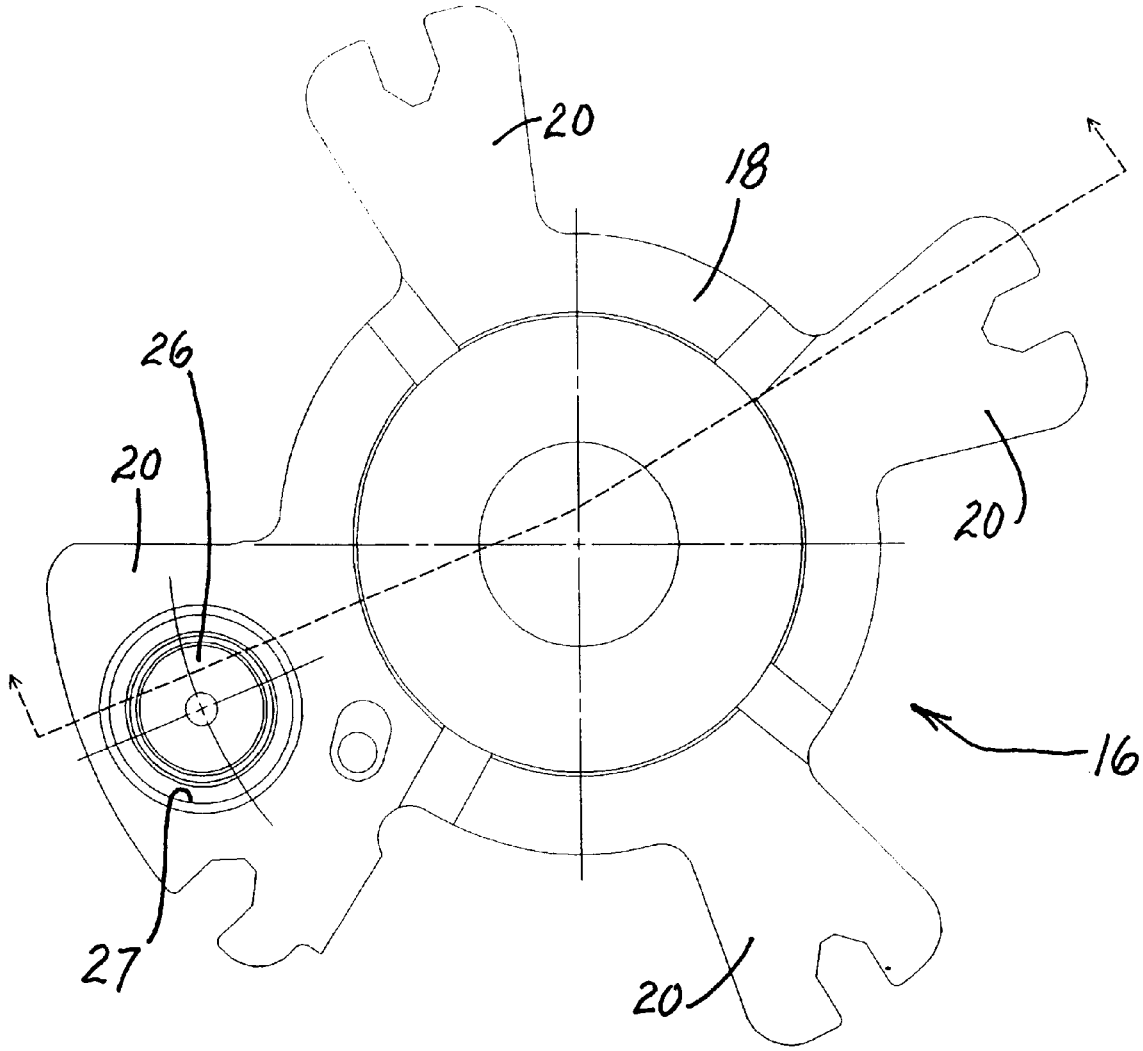
FIG. 2 is an axial view of the complete rotor shown in FIGS. 1*a* and 1*b;*
Figure 3:
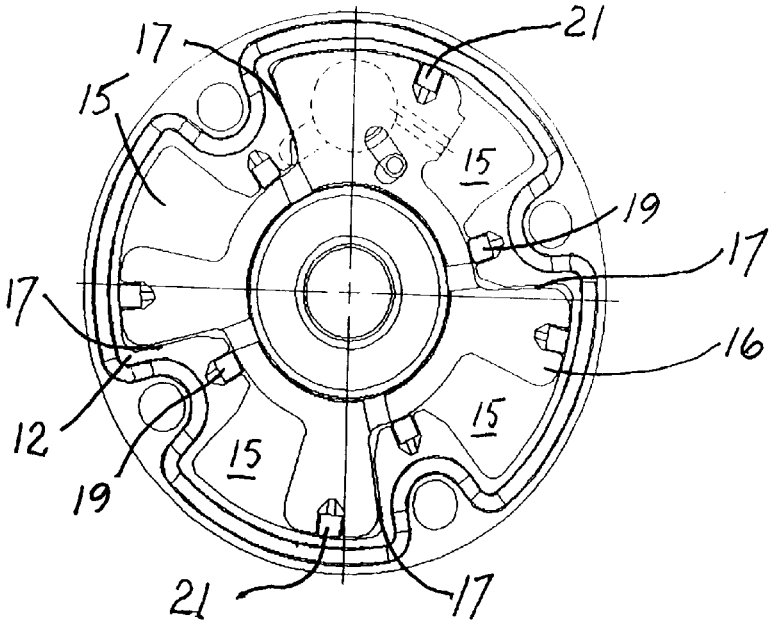
FIG. 3 is an axial view showing the rotor assembled into the stator.

Referring to FIGS. 1*a* and 1*b*, vane-type cam phaser 10 includes a stator 12 having a plurality of inwardly-extending lobes 14, and a rotor 16 having a cylindrical hub 18 and a plurality of outwardly-extending vanes 20. As best shown in FIG. 3, when rotor 12 is assembled into stator 16, a plurality of timing-advancing chambers 15 and timing-retarding chambers 17 are formed between the rotor vanes and the stator lobes. Axially-extending lobe seals 19 and vane seals 21 prevent hydraulic leakage between the chambers. Referring again to FIGS. 1*a* and 1*b*, back plate 22, which seals the back side of stator 12, rotor 16, and the plurality of chambers 15,17 is attached to sprocket 24 for being rotationally driven, as by a timing chain or ribbed belt, from a crankshaft sprocket or gear in known fashion. Bore 23 in back plate 22 typically is receivable of the outer end of an engine camshaft (not shown) on which phaser 10 may be thus mounted in known fashion. Opposite back plate 22 is a cover plate 28 for sealing the front side of the phaser hydraulics analogously to back plate 22. Bolts 34 extend through cover plate 28 and stator 12 and are secured into threaded bores 36 in back plate 22. The assembled cover plate, stator, and back plate define a unitized housing wherein rotor 16 may rotate through an axial angle sufficient to advance or retard the opening of engine valves through a predetermined angular range, typically about 30°. An actuable locking pin assembly 26 disposed in recess 27 in a vane of rotor 16 may be extended at certain times in the cam phaser operation, such as during engine start-up, to engage bore 29 in back plate 22 for preventing relative rotation between the rotor and stator. FIG. 2 is a bottom view of rotor 16 showing hub 18, vanes 20, locking pin recess 27, and locking pin assembly 26. Cam phaser 10 is provided with suitable and separate porting so that engine oil, under engine oil pump pressure, can be brought to bear controllably on either side 30 or side 32 of vanes 20 to rotationally advance or retard the rotor by directing oil into either advancing chambers 15 or retarding chambers 17 (FIG. 3).

Figure 4:
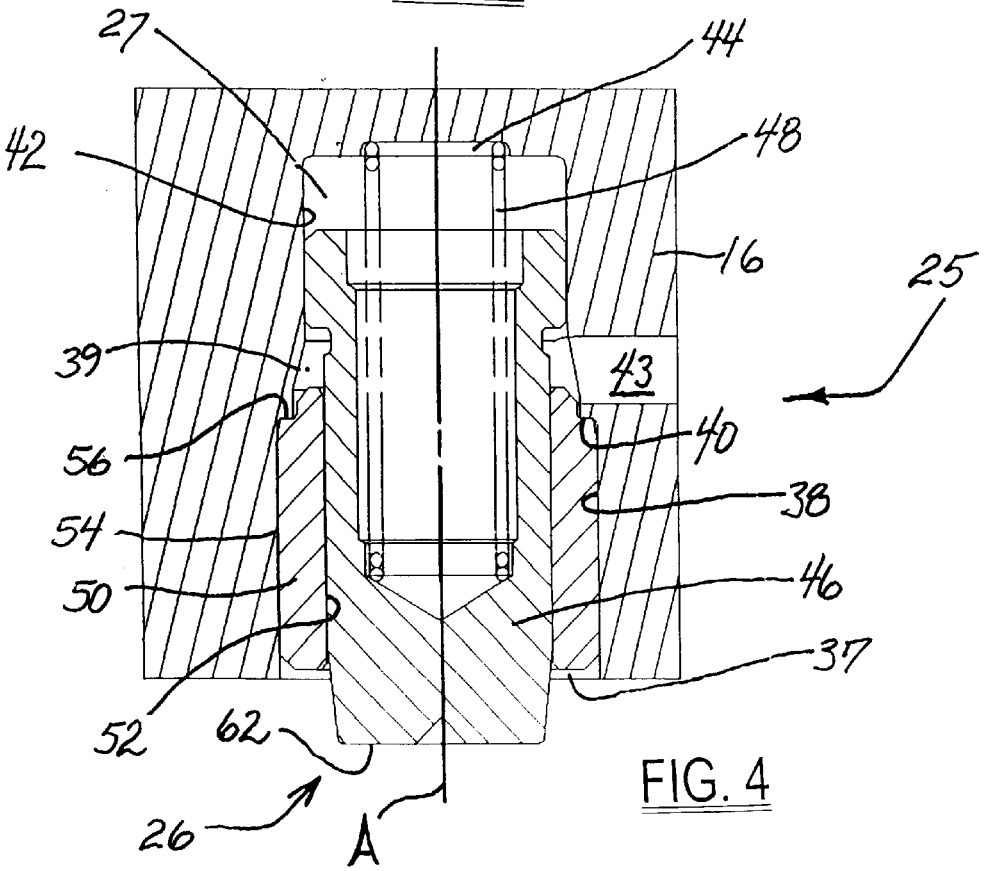
FIG. 4 is a side cross-sectional view of the locking pin mechanism of the present invention.

Referring to FIG. 4, there is shown one embodiment of locking pin mechanism 25 having an improved locking pin/pin recess/guide bushing geometry. Pin assembly 26 is shown assembled into pin recess 27 of rotor 16. As will be more particularly described hereinafter, pin assembly 26 is disposed concentrically within rotor pin recess 27. Pin recess 27, having central axis A, defines opening 37, first bore 38, annular stop 40, and second bore 42. Portion 39 forms a transition surface between annular stop 40 and second bore 42. Transverse oil passage 43 is in fluid connection with the retard porting of the cam phaser (not shown) and with transition portion 39. Pin recess further defines spring pocket 44.

Locking pin assembly 26 includes generally cylindrical pin 46, coil spring 48, and guide bushing 50 having inside cylindrical surface 52, outside cylindrical surface 54, and annular step 56. Outside surface 54 is dimensioned to be press fittedly and concentrically received within first bore 38 such that its central axis coincides with central axis A of pin recess 27. When bushing 50 is assembled into first bore 38, annular step 56 locates against annular stop 40 thereby serving to axially position bushing 50 within bore 38. Bushing 50 is constructed of, for example, hardened or hardenable steel.

Figure 5:
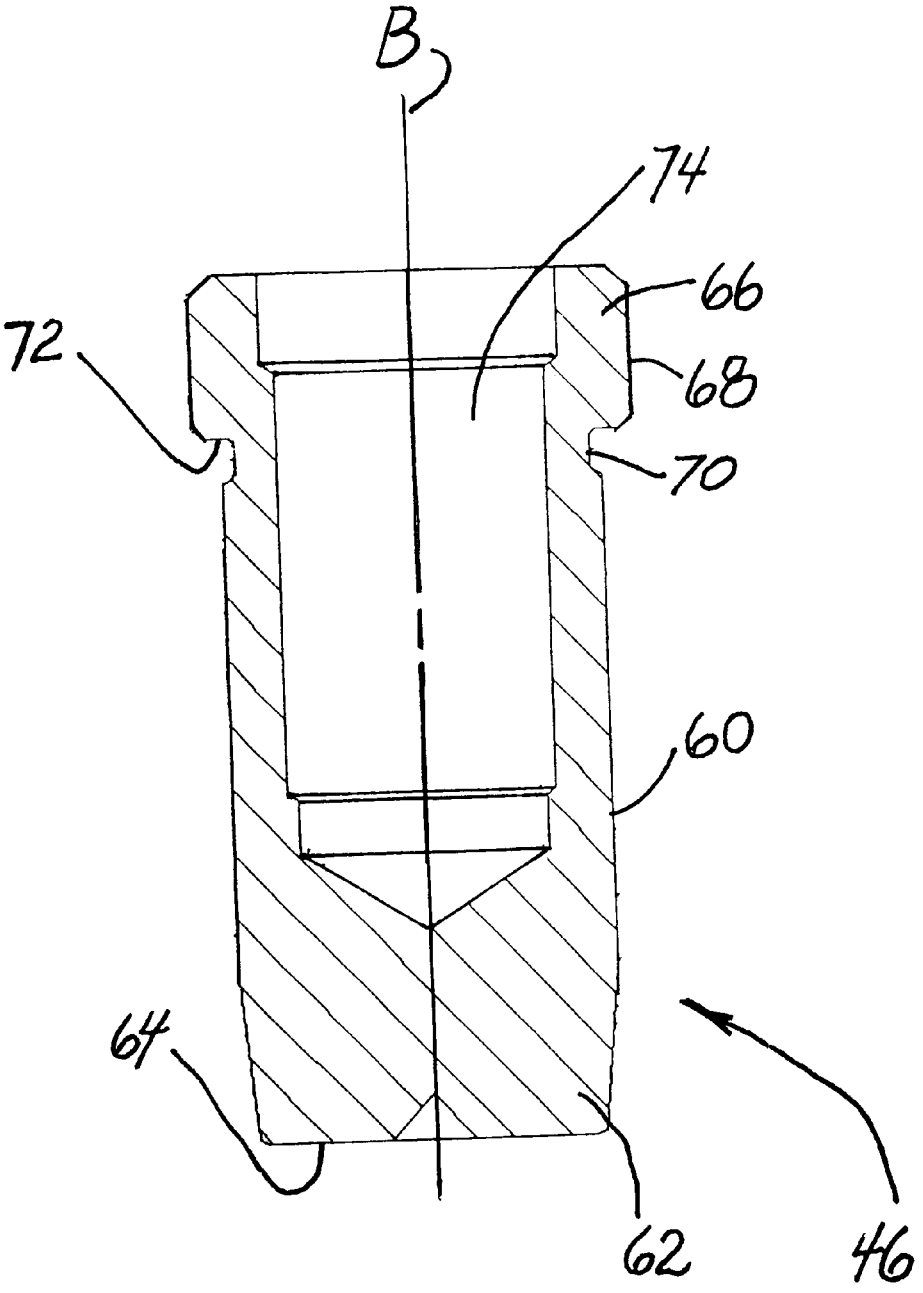
FIG. 5 is a side cross-sectional view of the locking pin shown in FIG. 4.

Referring to FIG. 5, cylindrical locking pin 46, includes central axis B, and first guide surface 60. The diameter of first guide surface 60 is dimensioned to be slidably received in a relatively fluid tight arrangement within the diameter of inside cylindrical surface 52 of bushing 50. Pin 46 also defines nose portion 62, end surface 64 of nose portion 62, and flange end 66 opposite nose portion 62. Flange end 66 includes second guide surface 68. The diameter of second guide surface 68 is larger than the diameter of first guide surface 60, is spaced generally coaxially with the diameter of first guide surface 60, and is dimensioned to be slidably received in a relatively fluid tight arrangement within the diameter of second bore 42 of pin recess 27. Annular recess 70 and land 72 are disposed between first guide surface 60 and second guide surface 68. Locking pin 46 also defines spring well 74. Locking pin 46 is constructed of, for example, hardened or hardenable steel.

Coil spring 48 is disposed between and within spring pocket 44 and spring well 74 to bias pin 46, in an outward direction toward back plate 22. Coil spring 48 is constructed of, for example, music wire.

In use, under conditions of low engine oil pump pressure such as during startup, locking pin assembly 26 serves to lock rotor 16 and stator 12 together, to thereby substantially prohibit relative rotational motion between the rotor and stator. In this locked or default mode, the rotor and stator are mechanically coupled together and rotate as one, similar in function to a one piece camshaft sprocket known in the art. In the default mode, nose portion 62 of pin 46 engages pin bore 29 in back plate 22. Preferably, nose portion 62 is tapered and dimensioned to facilitate engagement and disengagement with bore 29. Under normal operation engine oil pump pressures (such as, for example, pressures above 14.5 psi), pin 46 moves against spring 48 and is taken out of engagement with bore 29 by the injection of pressurized engine oil through two oil channels, as will now be described. When pressurized oil is directed to advance chambers 15 to move rotor 16 in a counterclockwise direction (FIG. 3), pressurized oil is also directed to transverse oil passage 43 (FIG. 4). Pressurized oil from passage 43 bears on annular land 72 causing pin 46 to be retracted into pin recess 27 against the force of spring 48 thereby disengaging nose portion 62 of pin 46 from pin bore 29 and decoupling rotor 16 from stator 12. When pressurized oil is directed to retard chambers 17 to move rotor 16 in a clockwise direction (FIG. 3), pressurized oil is also directed through a retard oil passage in back plate 22 (not shown). Pressurized oil from the retard oil passage bears on end surface 64 of pin 46 causing pin 46 to be similarly retracted into pin recess 27 against the force of spring 48 thereby disengaging nose portion 62 of pin 46 from pin bore 29 and decoupling rotor 16 from stator 12. A vent passage (not shown), disposed in rotor 16 proximate spring pocket 44, serves to return oil that has leaked past pin 46 to the engine sump (not shown).

Although locking pin mechanism 25 described above serves to mechanically couple and decouple rotor 16 and stator 12 in a manner generally similar to conventional locking pin mechanisms used in vaned cam phasers, the dimensional geometry of locking pin 46, pin recess 27, and guide bushing 50 distinguishes locking pin mechanism from a conventional mechanism.

As generally described above, optimum sizing of first guide surface 60 and second guide surface 68 of pin 46 serves a dual but opposing function. First, surfaces 60, 68 must be diametrically sized to be loosely received within bushing 50 and bore 42, respectively, to assure free axial movement of pin 46. Second, surfaces 60, 68 must be diametrically sized to form a relatively fluid tight arrangement between the surfaces and their mating bores to minimize oil leakage past the pin. For example, the diameter of first guide surface 60 is approximately 9.0 mm and the diameter of second guide surface 68 is approximately 10.4 mm. In order to assure both free movement of and minimal oil leakage around pin 46, the diameters of inside cylindrical surface 52 and second bore 42 are dimensioned to provide nominal diametrical clearances of approximately 0.030 mm.

Figure 6A:
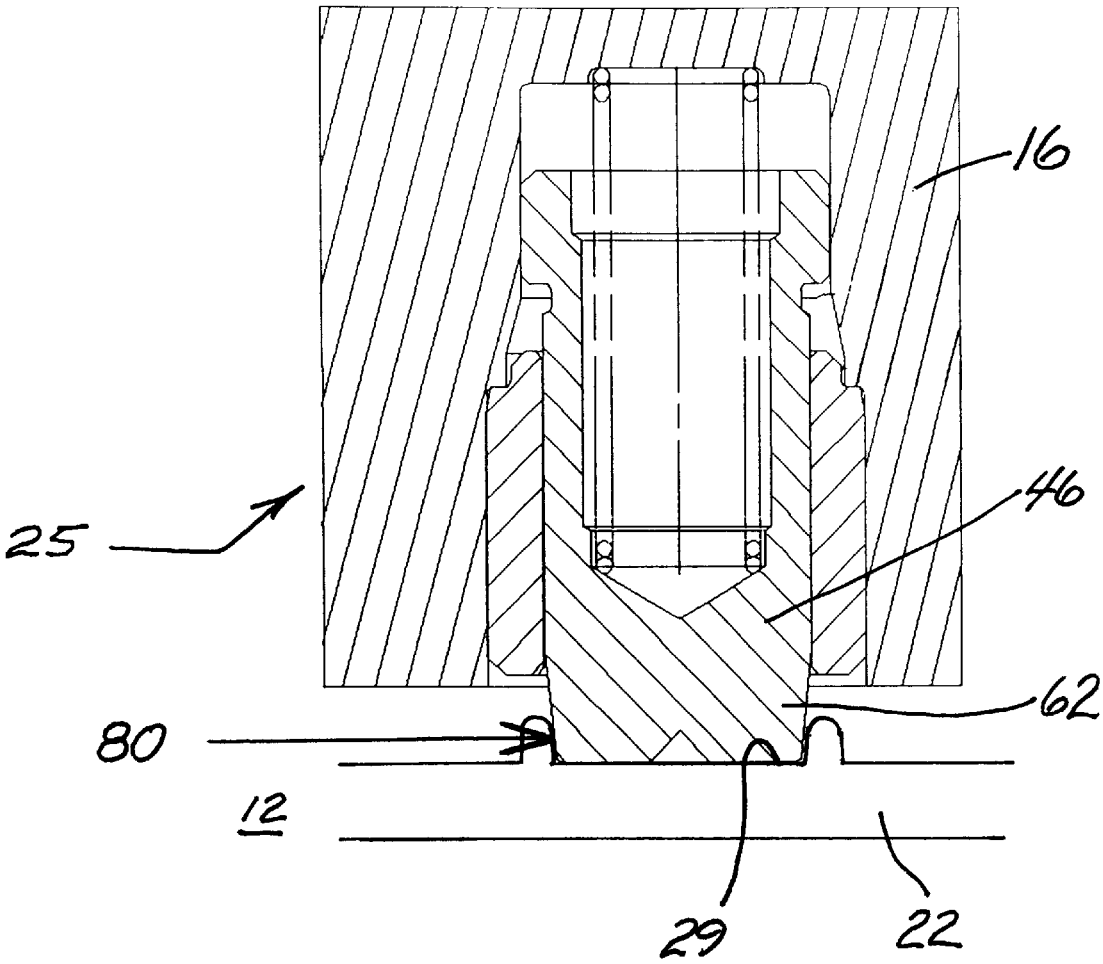
FIG. 6*a* is a side cross-sectional view of the locking mechanism shown in FIG. 4, showing the forces exerted on the locking pin by the stator.
Figure 6C:
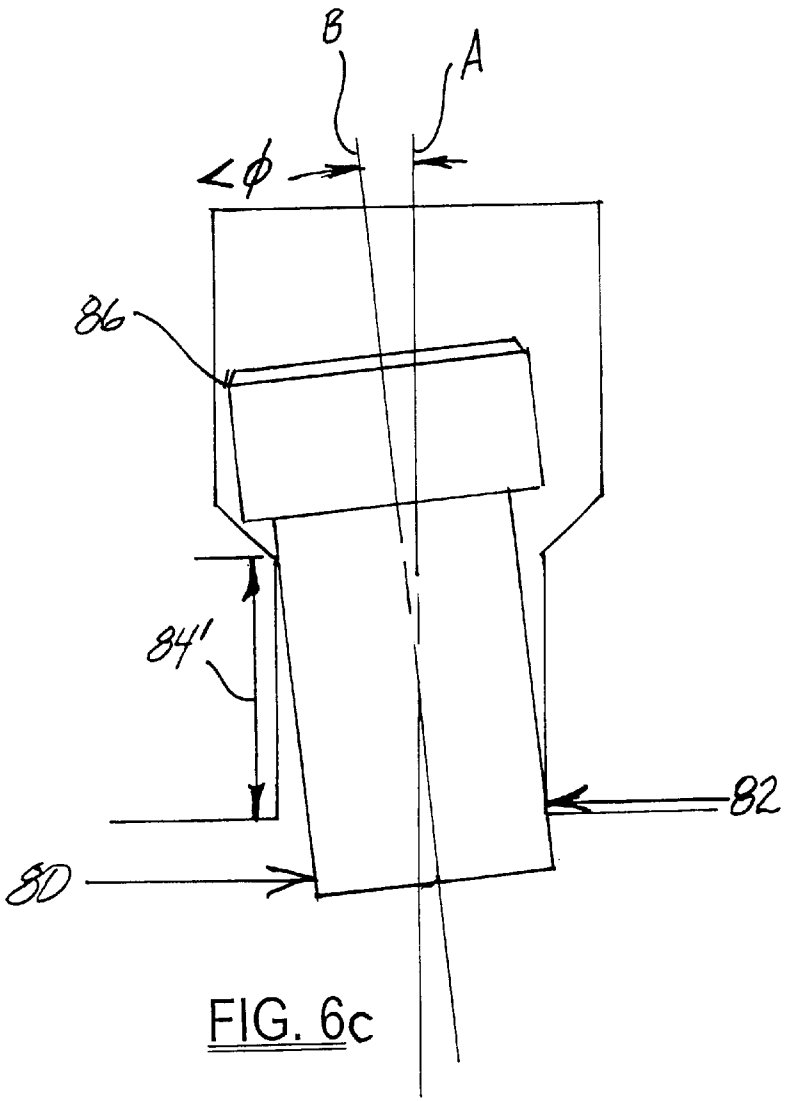
FIG. 6*c* is a schematic view of the locking mechanism of the present invention showing the forces exerted on the locking pin by the stator in exaggerated form for clarity.
Figure 6B:
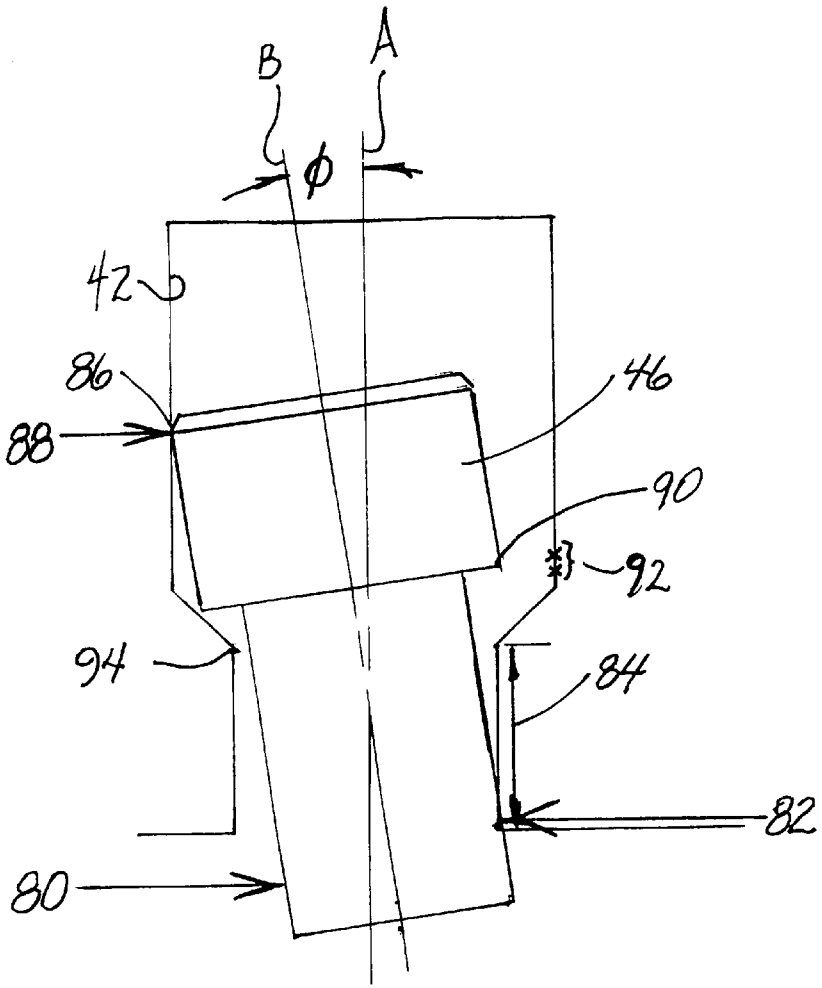
FIG. 6*b* is a schematic view of the prior art locking mechanism showing the forces exerted on the locking pin by the stator in exaggerated form for clarity.

A condition causing binding of pin 46 and imprecise control over pin retraction when the pin is laterally loaded by the rotational forces of the stator is known to currently exist. FIG. 6*a* depicts locking pin mechanism 25 in its default, extended position whereby nose portion 62 of pin 46 is engaged in pin bore 29 of back plate 22 and rotor 16 is mechanically coupled to stator 12. A torsional force applied to stator 12 by the engine crankshaft causes pin 46 to be laterally loaded as shown by the arrow identified as numeral 80 and causes binding or sluggish movement of the pin in the retraction direction. An exaggerated schematic representation of one binding condition known to exist in the prior art is illustrated in FIG. 6*b*. Force vector 80 applied to pin 46 causes central axis B of the pin to be angularly displaced, counterclockwise, from central axis A of pin recess 27 because of opposing force vector 82. Because the length of bore 84 (defined by the length of guide bushing 50) is not great enough limit the pin's rotation, the angular rotation Φ of pin 46 causes edge 86 of pin flange end 66 to contact second bore 42 thereby inhibiting predictable and relatively free axial movement of pin 46. That is, opposing vector force shown as numeral 88 causes pin 46 to bind and to act erratically in response to the application of pressurized oil. A second binding condition known to exist occurs when, under lateral loading of pin 46 as illustrated by FIG. 6*b*, lower shoulder 90 of pin 46 contacts the wall of second bore 42, in the area shown in FIG. 6*b* as numeral 92, before first guide surface 60 makes contact with point 94.

It has been found that by selectively sizing the axial length of guide bushing 50 relative to the axial length of second guide surface 68, the tendency of pin 46 to bind when laterally loaded by the stator is substantially reduced. FIG. 6*c* schematically illustrates the advantage of one embodiment of the present invention. As compared to FIG. 6*b*, the longer length of bore 84' limits the pin's rotation to an angle less than Φ and prevents edge 86 from contacting second bore 42. That is, opposing vector force 88 is eliminated.

Figure 7:
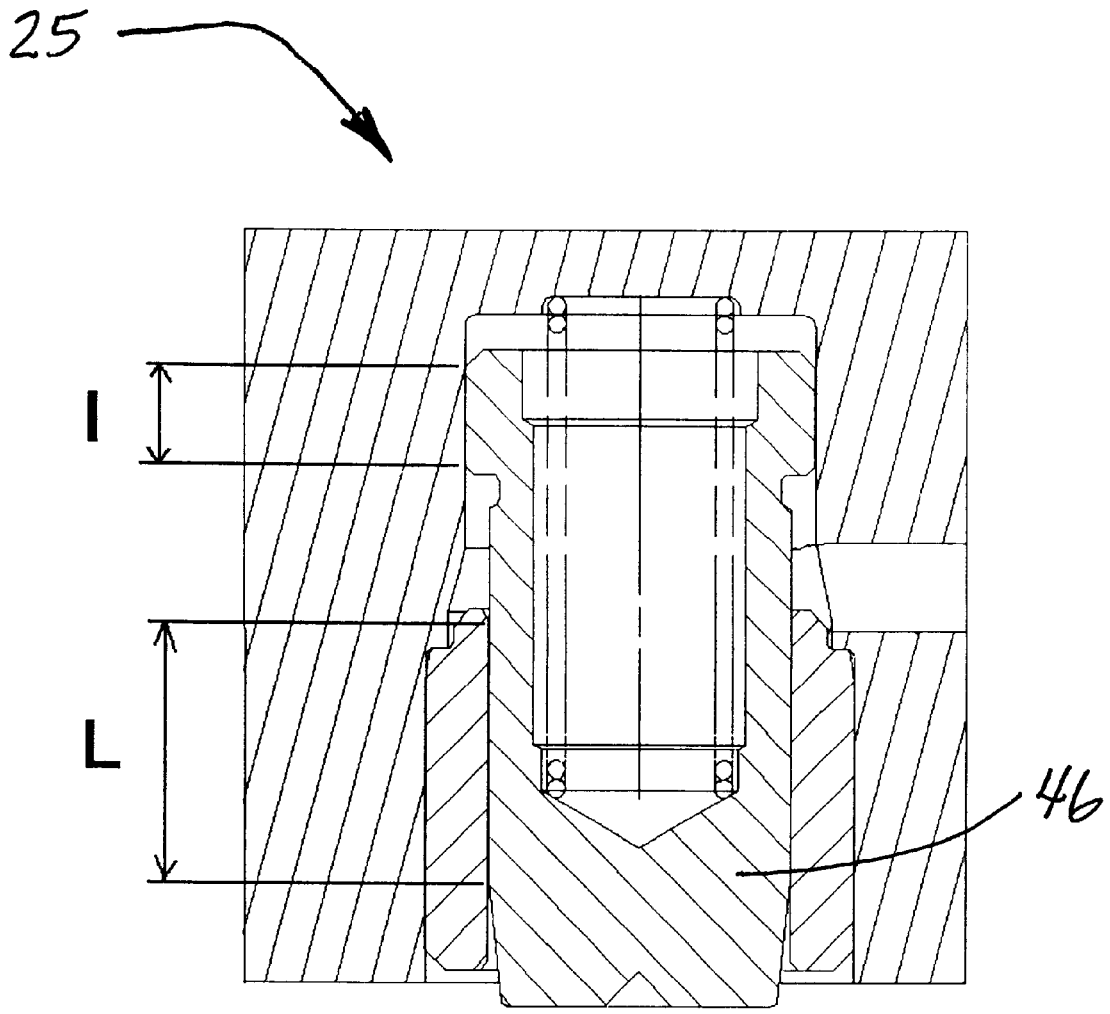
FIG. 7 is a additional side cross-sectional view of the locking pin mechanism of the present invention.

Referring now to FIG. 7, pin 46 of locking pin mechanism 25 is shown in an almost fully retracted position. Where diameter of first guide surface 60 is approximately 9.0 mm and the diameter of second guide surface is approximately 10.4 mm, it has been found that the tendency of pin 46 to bind when laterally loaded by the stator is substantially reduced when the L/I ratio is greater than 1.7 and preferably greater than 2.

In the embodiment shown, the diameters of the first guide surface and the second guide surface of pin 46 are defined as 9.0 mm and 10.4 mm, respectively. However, it is understood that the respective diameters can be alternately sized smaller or larger than the diameters disclosed and still be advantageously affected by the application of the prescribed L/I ratios.

The foregoing description of the invention, including a preferred embodiment thereof, has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A vaned cam phaser, comprising:

a) a unitized housing including a lobed stator;

b) a vaned rotor disposed within said stator; and c) a locking pin assembly disposed in said rotor for selectively coupling said rotor and stator together wherein said locking pin assembly includes a guide bushing defining an inside cylindrical surface having an axial length (L) and a pin defining a second guide surface having an axial length (I) wherein an L/I ratio is greater than 1.7.

2. A cam phaser in accordance with claim 1 wherein said L/I ratio is approximately 1.7.

3. A cam phaser in accordance with claim 1 wherein said L/I ratio is greater than 2.

4. A cam phaser in accordance with claim 1 wherein said L/I ratio is approximately 2.

5. A cam phaser in accordance with claim 1 wherein said pin includes a first guide surface and said rotor defines a pin recess for receiving said locking pin assembly, said pin recess having a second bore, wherein the diametrical clearances between said first guide surface and said inside cylindrical surface, and between said second guide surface and said second bore are approximately 0.030 mm.

* * * * *

UNITED STATES PATENT AND TRADEMARK OFFICE

CERTIFICATE OF CORRECTION

PATENT NO. : 6,742,485 B2
DATED : June 1, 2004
INVENTOR(S) : Thomas H. Lichti et al.

It is certified that error appears in the above-identified patent and that said Letters Patent is hereby corrected as shown below:

Title page,
Item [75], Inventors, should read as follows:

-- Thomas H. Lichti, Fairport, NY (US);
Mark D. Lemieux, Conklin, MI (US);
Joel B. Lemieux, Coopersville, MI (US);
Emily E. Foster, Pierson, MI (US); and
Donald T. Truszkowski, Grand Rapids, MI (US) --

Signed and Sealed this

Twenty-seventh Day of July, 2004

JON W. DUDAS
*Acting Director of the United States Patent and Trademark Office*